US007182579B2

(12) United States Patent
Roso et al.

(10) Patent No.: US 7,182,579 B2
(45) Date of Patent: Feb. 27, 2007

(54) DEVICE AND METHOD FOR DETACHABLY CONNECTING AN IMPELLER TO A SHAFT

(75) Inventors: Carlo A. Roso, Farmington, KY (US); Gary B. Owens, Bardwell, KY (US)

(73) Assignee: Ingersoll-Rand Company, Montvale, NJ (US)

( * ) Notice: Subject to any disclaimer, the term of this patent is extended or adjusted under 35 U.S.C. 154(b) by 0 days.

(21) Appl. No.: 11/170,032

(22) Filed: Jun. 29, 2005

(65) Prior Publication Data

US 2005/0287006 A1 Dec. 29, 2005

Related U.S. Application Data

(60) Provisional application No. 60/583,932, filed on Jun. 29, 2004.

(51) Int. Cl.
*F04D 29/20* (2006.01)
*F04D 29/26* (2006.01)

(52) U.S. Cl. ..... 416/204 A; 416/244 A

(58) Field of Classification Search ..... 416/204 A, 416/244 A; 415/216.1; 403/374.4; 464/182
See application file for complete search history.

(56) References Cited

U.S. PATENT DOCUMENTS 6,254,349 B1 7/2001 Haugen et al.
6,461,111 B1 * 10/2002 Haugen et al. ..... 416/244 R
6,499,958 B2 12/2002 Haugen et al.
6,616,412 B2 9/2003 Haugen et al.
6,896,479 B2 * 5/2005 Svihla et al. ..... 416/244 R

* cited by examiner

*Primary Examiner*—Richard A. Edgar
(74) *Attorney, Agent, or Firm*—Michael Best & Friedrich LLP

(57) ABSTRACT

A rotor assembly for a turbomachine includes an impeller, a shaft, a bolt, and a compliant spacer. The impeller has an opening extending in an axial direction and a stem with an outer surface having a tapered profile in a cross section including the axis and a non-circularly symmetric profile in a cross section perpendicular to the axis. The shaft includes a bore that is configured to receive and engage the impeller stem. The bolt connects the impeller to the shaft, and the compliant spacer is located between a first surface of the shaft and a first surface of the impeller, wherein the compliant spacer substantially conforms to the first surface of the shaft and to the first surface of the impeller when the bolt is tightened to a predetermined torque value.

20 Claims, 4 Drawing Sheets

DEVICE AND METHOD FOR DETACHABLY CONNECTING AN IMPELLER TO A SHAFT

CROSS REFERENCE TO OTHER APPLICATIONS

This application claims priority under 35 U.S.C. sec. 119 to provisional patent application No. 60/583,932, filed on Jun. 29, 2004, which is hereby incorporated by reference.

FIELD OF THE INVENTION

The present invention relates to a device and a method for detachably connecting an impeller to a shaft in a high-speed turbomachine.

BACKGROUND OF THE INVENTION

In order to prevent the development of harmful vibrations during the high-speed operation of a rotor assembly in a turbomachine, such as a fluid centrifugal compressor, multi-plane dynamic balancing of the rotor assembly is typically performed, generally prior to the final mounting of the rotor assembly in the turbomachine. Often, the components of the rotor assembly must be detached from one another after dynamic balancing to allow for the installation of the rotor assembly in the turbomachine. Repeatability in mutually locating the individual components during the re-assembly of the rotor assembly is important in order to maintain the initial balanced condition of the whole mechanical system, insure vibration free mode of operation, and prevent relative motion between parts that is known to induce, in addition to vibration, damage from fretting at the interface boundaries of the affected components. In fact, the relatively high rotational speed of operation of a rotor assembly in a turbomachine, perhaps in excess of 100,000 revolutions per minute, induces a significantly large number of load cycles in a very short period of time. Consequently, if relative movement between the components of the impeller-to-shaft connection develops during operation, premature damage of the components would result, thus preventing their re-use after normal expected maintenance of the turbomachine.

Customarily, some methods for detachably connecting an impeller to a shaft rely on a severe diametral interference between a cylindrical or conical impeller stem and the shaft to transmit the torque by friction; hydraulic or temperature assisted methods are required to assemble the impeller stem to the shaft, thus adding complexity to the system geometry, as well as to the methodology for mounting and dismounting the impeller from the shaft. If, because of structural and assembly limitations, a friction type coupling has a relatively modest diametral interference between the impeller stem and the shaft, then the resultant torque capacity of a coupling would be relatively limited and in operation, slippage between the components may occur, especially in the event of manufacturing errors in the constructions of the interfacing components.

For example, the impeller and shaft typically can be coupled by a polygon attachment method. The principal advantages of the polygon attachment method are its ease of assembly/disassembly and self centering characteristic. The polygon must consistently lock up the impeller and shaft at the same position to maintain the needed level of rotor balance. Any relative movement between the shaft and the impeller leads to unacceptable levels of vibration during compressor operation. To ensure the requisite consistency is obtained, the mating parts must be machined to very exacting tolerances so as to properly function during the operation of the rotor assembly especially under the application of transient induced load events typical in high-speed fluid turbomachinery.

SUMMARY OF THE INVENTION

Start-up transients of a typical turbomachine driven by a synchronous electric motor are accompanied by the development of a significantly large, inertia induced, bi-directional oscillating torque in excess of several times the fluid power generated torque at nominal operating conditions of the turbomachine. Because of the development of a bi-directional oscillating torque during start-up, it is important that the impeller-to-shaft connection have shock load absorbing characteristics so as to maintain mechanical integrity after an unlimited number of start-up cycles. During operation, time dependent temperature gradients among the components of the rotor assembly impose differential thermal expansions within the interfacing parts that must be properly dissipated so as to maintain the mechanical integrity of the whole rotor system. Differential thermal expansions are also often emphasized by the required utilization of materials, within the rotor assembly, having different mechanical and physical properties.

Further, it is desirable that a rotor assembly be assembled and disassembled while preserving detachability properties without compromising the mechanical performance of the assembly.

One embodiment of a rotor assembly in accordance with the present invention includes an impeller operable to rotate around an axis and having an opening extending in an axial direction. The impeller includes a stem with an outer surface having a tapered profile in a cross section including the axis and a non-circularly symmetric profile in a cross section perpendicular to the axis. The rotor assembly also includes a rotatable shaft, the shaft including a bore extending in the axial direction, wherein the bore is configured to receive and engage the impeller stem when the shaft is rotating. A bolt is insertable into and through the impeller opening and into the bore for connecting the impeller to the shaft. The rotor assembly also includes a compliant spacer between a first surface of the shaft and a first surface of the impeller, wherein the compliant spacer substantially conforms to the first surface of the shaft and to the first surface of the impeller when the bolt is tightened to a predetermined torque value.

DETAILED DESCRIPTION OF THE PREFERRED EMBODIMENTS

The present invention will be described with reference to the accompanying drawing figures wherein like numbers represent like elements throughout. Certain terminology, for example, "top", "bottom", "right", "left", "front", "frontward", "forward", "back", "rear" and "rearward", is used in the following description for relative descriptive clarity only and is not intended to be limiting.

Figure 1:
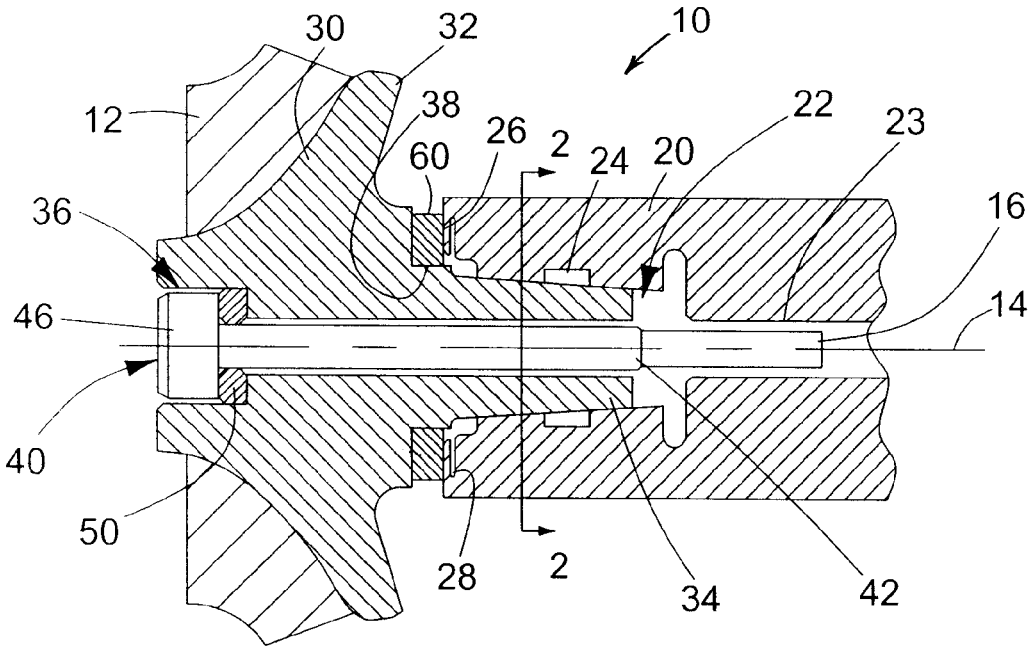
FIG. 1 is a cross-sectional view showing the interconnection of an impeller and a shaft in accordance with a first embodiment of the present invention.
Figure 2:
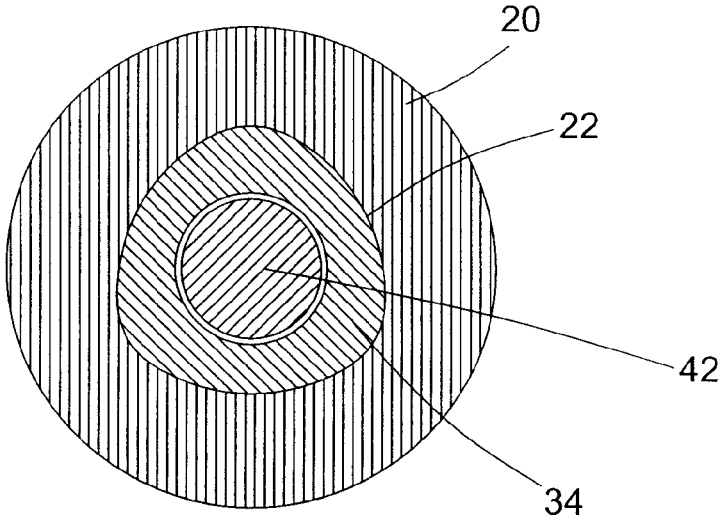
FIG. 2 is a cross-sectional view along the line 2—2 in FIG. 1.

Referring to FIGS. 1 and 2, illustrated is a first embodiment of a rotor assembly 10 for use in a turbomachine such as a fluid centrifugal compressor, for example. The rotor assembly 10 generally comprises an impeller 30 connected to a shaft 20 by a bolt 40. A spacer 60, of compliant material, is provided between the impeller 30 and the shaft 20, as more fully described hereinafter. The rotor assembly 10 is operable to rotate about an axis 14 at high speeds.

In particular, the impeller 30 includes a blade portion 12 and a hub portion 32, as is generally known in the art, and a connection stem 34. A bolt receiving opening 36 is provided in the impeller 30 and extends in the axial direction. The stem 34 has an outer surface including a tapered profile in a cross section including the axis 14, as shown in FIG. 1, and a non-circularly symmetric profile, such as a multi-lobe harmonic profile, in a cross section perpendicular to the axis 14, as shown in FIG. 2. In particular, the multi-lobe harmonic profile, in a cross section that is perpendicular to the axis, is defined by the following Cartesian coordinates as trigonometric sine and cosine functions:

$$X = \left(\frac{D_i}{2} + e\right)\cos\alpha - e\cos n\alpha\cos\alpha - ne\sin n\alpha\sin\alpha$$

$$Y = \left(\frac{D_i}{2} + e\right)\sin\alpha - e\cos n\alpha\sin\alpha + ne\sin n\alpha\cos\alpha$$

where:

$D_i$=Diameter of profile circumscribed circle e=The eccentricity displacement of the profile $\alpha$=The angular coordinate n=Number of profile lobes For example, in one embodiment, the following values are used: $D_i$=1.75 units, e=0.040 units, and n=3. The geometric size, shape, and geometric tolerances of the profile, with respect to other features present in the rotor assembly 10 should all be met simultaneously to achieve a satisfactory impeller-to-shaft coupling.

With respect to the shaft 20, shaft 20 can be, for example, a pinion shaft including a pinion gear (not shown) which is engageable with a power transmission assembly (not shown) which drives the shaft 20 about the axis 14 at a predetermined rotational speed in the centrifugal compressor. Shaft 20 has a bore 22 configured to receive and engage the impeller stem 34, and to receive the bolt. In other words, an inner surface machined in the shaft 20 substantially conforms to or mates with the outer surface of the impeller stem 34. In particular, in one embodiment a portion of the bore 22 is defined by an inner surface of the shaft having a generally tapered profile in a cross section including the axis 14 and a non-circularly symmetric profile, such as a multi-lobe harmonic profile, in a cross section perpendicular to the axis 14. Bore 22 also includes a threaded end portion 16 including threads 23 for receiving the bolt 40. The size of the inner surface of the shaft 20 is such that a diametral interference develops with the outer surface of the impeller stem 34 when the bolt 40 is tightened to a specified, predetermined torque value. To enhance the manufacturing of the rotor assembly 10, the tolerance to which the inner surface of the shaft 20 is machined can be larger than the one defined for the interfacing surface on the impeller stem 34. As shown in FIG. 1, the bore 22 may also include a circumferential groove 24 to reduce friction force between the stem 34 and shaft 20 during assembly.

The differential tolerance grade between the interfacing surfaces can be set so that impeller stems 34 can be associated with shafts 20 having a different tolerance grade, but always having the same fundamental deviation. The fundamental deviation represents the closest, expected by design, distance between the diametral size of the component and the basic or nominal size of the component. The approach allows for the interchangeability of impellers 30 while utilizing a common shaft 20; which can provide greater flexibility since the impeller 30 is the component of the rotor assembly 10 that is most frequently substituted during factory testing or during the re-furbishing of the turbomachine.

The impeller 30 is connected to the shaft 20 with the bolt 40. Specifically, the bolt 40 has a shaft 42 that extends through the impeller 30 and engages threads 23 within the shaft bore 22. The bolt 40 also includes a head 46 that is received in an impeller bolt receiving opening 36 of the impeller 30 to retain the impeller 30 axially. A bolt centering device, for example, a bolt washer 50, is preferably provided in the opening 36 about the bolt shaft 42 to keep the bolt 40 centered within the impeller during assembly and balance, and during the high-speed operation of the rotor assembly 10. The bolt 40 is preferably manufactured from a high strength alloy steel. The bolt 40 is utilized to induce the required diametral interference between the interfacing harmonic tapered profiles of the impeller stem 34 and the shaft 20. The bolt 40 also provides a prevalent axial loading of the coupling to absorb, as allowed by the compliant spacer 60 and other optional compliant features of the coupling, axial displacements of the components due to body generated forces and temperature gradient induced loads.

Figure 3:
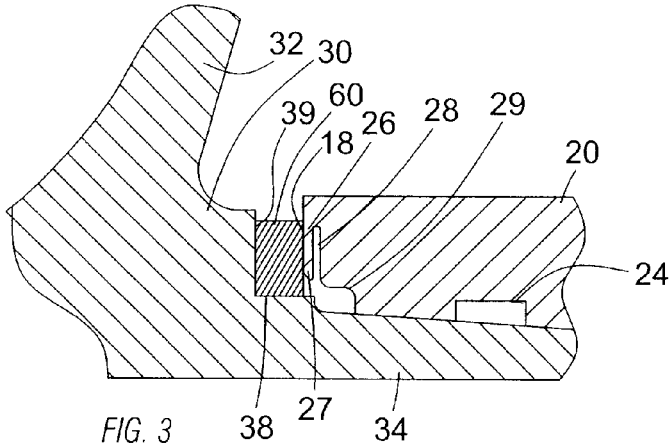
FIG. 3 is an exploded view of a portion of FIG. 1, showing the interconnection of the impeller and the shaft.
Figure 4:
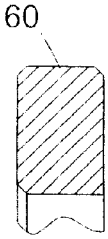
FIG. 4 shows a partial cross-sectional view of a spacer.
Figure 15:
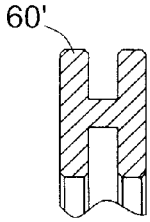
FIG. 15 shows a partial cross-sectional view of another spacer.
Figure 16:
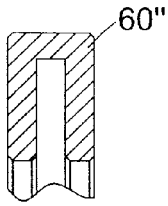
FIG. 16 shows a partial cross-sectional view of another spacer.
Figure 17:
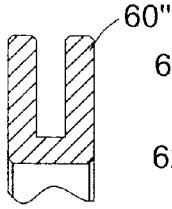
FIG. 17 shows a partial cross-sectional view of another spacer.
Figure 18:
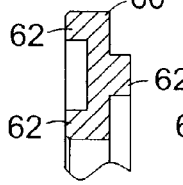
FIG. 18 shows a partial cross-sectional view of another spacer.
Figure 19:
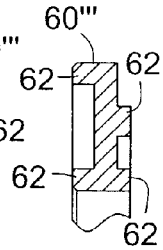
FIG. 19 shows a partial cross-sectional view of another spacer.
Figure 5:
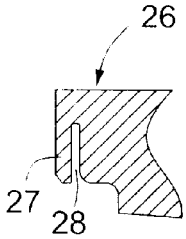
FIG. 5 shows a partial cross-sectional view of a shaft end portion configuration.
Figure 20:
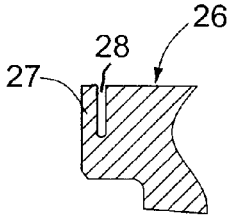
FIG. 20 shows a partial cross-sectional view of another shaft end portion configuration.
Figure 21:
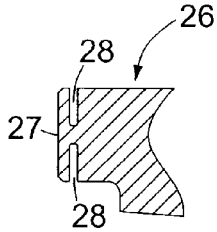
FIG. 21 shows a partial cross-sectional view of another shaft end portion configuration.
Figure 22:
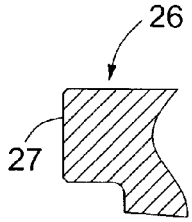
FIG. 22 shows a partial cross-sectional view of another shaft end portion configuration.

As shown in FIGS. 1 and 3, the compliant spacer 60 is provided between the shaft 20 and the impeller 30. In a preferred embodiment, the compliant spacer is made of stainless steel, such as a grade 303 or grade 304 stainless steel. Further, spacer 60 is generally ring-shaped and in one embodiment, has a generally rectangular cross section in a plane including the axis 14, as shown in FIG. 1. Under sufficient axial loading, the spacer 60 conforms to the geometry of the interfacing surfaces, thus preventing point or line loading contact due to local misalignment of the components at assembly and during operation. In particular, in one embodiment, the compliant spacer 60 is located between a first surface 18 of the shaft 20 and a first surface 39 of the impeller 30, and the compliant spacer substantially conforms to the surface 18 and to the surface 39 when the bolt 40 is tightened to a predetermined torque value. Further, the first surface 39 of the impeller is substantially normal to the axis 14, as is the first surface 18 of the shaft 20.

Thus, when the components of the rotor assembly 10 are fully assembled, the use of the compliant spacer 60 effectively de-couples the actual machined sizes of the interfacing profiles from the consequent diametral interference, and leads to a further relaxation in the fit requirement of having the same fundamental deviation among the interfacing profiles. The manufacturing of a harmonic multi-lobe tapered profile customarily requires high precision machining, especially when the appropriate diametral interference between the interfacing profiles of the impeller stem 34 and the shaft 20 is obtained as the interfacing surfaces of the impeller and the shaft become a pre-determined axial contact or mechanical stop. Use of the compliant spacer 60 in the rotor assembly 10 allows for a significant relaxation in the manufacturing tolerances of the interfacing surfaces of the impeller stem 34 and the shaft 20 while also enhancing the utilization of components manufactured outside the design specification and the refurbishing of used components.

As shown in FIG. 1, preferably, the non-inserted end of the tapered impeller stem 34 slightly protrudes from the bore 22 when the impeller stem 34 is inserted in the bore 22 and the bolt 40 is tightened to the predetermined torque value, and at the same time, at the opposite end, the tapered portion of the bore 22 extends beyond the inserted end of the impeller stem 34. This configuration helps to eliminate the development of edge load deformation or pinching at both ends of the impeller stem 34, thus preventing scoring of the contacting surfaces during the initial axial disengagement of the components.

The impeller 30 is thus removably connected to the shaft 20 using only the bolt 40 as a clamping device. The geometric size of the impeller inducer, the rotational speed of the impeller 30 and the mechanical properties of the impeller material may limit the actual size of the bolt 40, and therefore the magnitude of the clamping force available to achieve an optimal diametral interference between the surfaces of the impeller stem 34 and the shaft 20. Since the impeller 30 and the shaft 20 are assembled to a mechanical axial stop to insure a consistent clearance between the impeller 30 and the surrounding stationary components, very costly machining operations would be required to control the size and shape of the interfacing harmonic profiles to allow the assembly of the joint when a limited magnitude of the clamping force is available because of the relatively small size of the bolt 40.

The magnitude of the axial force required to assemble the connection is a linear function of the diametral interference between the impeller stem 34 and the shaft 20. The contingent diametral interference between the interfacing profiles is a function of, in addition to the nominal dimensions, the tolerance grade to which the profiles are manufactured. Practical considerations have demonstrated that a relaxation of the profile tolerance grade from a level proper for measuring tools to a more desirable and economical tolerance level established for large production industrial fits would result in excessive diametral interference and consequently in the inability of the bolt 40 to completely assemble the connection, or would result in an unacceptable diametral clearance condition between the components of the coupling. To facilitate proper coupling of the components while allowing for greater tolerances, the compliant spacer 60 is used.

In the embodiment illustrated in FIGS. 1–3, the spacer 60 is seated on a shoulder 38 formed on the impeller 30 adjacent the stem 34. The shoulder 38 is preferably a precision machined surface and the compliant spacer 60 can be assembled on the impeller stem 34 by means of a diametral interference fit. The compliant spacer 60, when assembled on the impeller stem 34, becomes an integral part of the impeller 30 during both the balancing procedure of the rotor assembly 10 as well as during the operation of the assembly 10 in the turbomachine. The diametral interference between the compliant spacer 60 and the impeller stem 34 is selected so as to insure contact between the impeller stem 34 and the spacer 60 in operation and during handling of the impeller 30. Nevertheless, the magnitude of the diametral interference at assembly is such that the compliant spacer 60, due to its relatively small thermal mass, can be removed from the impeller stem 34 by application of a modest source of heat. With respect to FIG. 3, the radial dimension of the shoulder 38 and an interfacing counterbore 29 in the shaft 20 are sized so as to prevent axial contact in the event of very large manufacturing errors.

As illustrated in FIGS. 4 and 15–19, in other embodiments, the spacer 60 can have various configurations in a cross-section that includes the axis 14 of the shaft. For example, the compliant spacer 60', 60" may have an H or U configuration, respectively. Alternatively, the spacer 60''' may have one or more contact surface 62 extending from either or both axial surfaces. The different cross-sections of the spacer 60 have been developed based on size, geometry, available bolt clamping load at assembly and operating conditions of the rotor system. The cross-sectional configuration of the compliant spacer 60 is carefully selected so as to account for any parallelism errors between the interfacing surfaces 39, 18 of the impeller 30 and the shaft 20. Parallelism errors can be due to the relaxed tolerance grade of the interfacing harmonic profiles of the impeller stem 34 and the shaft 20. The diametral size of the spacer 60 and the amount of contact area between the spacer surfaces and the corresponding surfaces on the impeller 30 and on the shaft 20 are defined so as to maximize the contact pressure on the spacer 60 at assembly based on the available bolt 40 clamping force so as to further enhance the compliant function of the spacer 60. The axial compliance and intrinsic flexibility of the spacer 60 enhances the axial contact between the interfacing surfaces, thus allowing for a prevalent axial compression of the impeller 30 and shaft 20 coupling as internal and external forces to the rotor assembly 10 tend to separate interfacing surfaces. The introduction of the spacer 60 effectively decouples the allowable diametral interference range at assembly from the contingent geometric size and shape of the interfacing profiles. Consequently, as the contingent geometry of the interfacing harmonic profiles could or would lead, because of the relaxed requirements in profile tolerance grade, from clearance to an excessive interference at assembly, the introduction of the interference controlling compliant spacer 60 constrains the diametral interference at assembly within the optimal range of values.

The compliant spacer 60 effectively allows a diametral interference at assembly near the maximum value allowed by the available clamping force of the bolt 40 to be obtained; the selection of the near maximum value of the diametral interference at assembly represents a desirable condition to insure significant profile lobe contact in high-speed and high specific power turbomachinery applications. Detailed analytical investigations and practical experience have demonstrated that radial separation of interfacing harmonic profiles naturally occurs on the unloaded side of a lobe during transmission of power at relatively high speeds of rotation. The increase in interference at assembly between interfacing harmonic profiles significantly improves the lobe contact pattern, enhances the suppression in relative motion among the engaged components, and effectively reduces rotor vibrations due to operating imbalance. It should be emphasized that a relaxation in profile geometric tolerances would not allow the optimal value of the profile diametral interference at assembly to be consistently obtained while utilizing the bolt 40 as the only means to complete the assembly of the impeller-to-shaft coupling.

Furthermore, the spacer 60 is preferably available in a variety of sizes (varying the thickness in the axial direction) such that an appropriate sized spacer can be selected from a finite number of spacers in a provided set of manufactured spacers to achieve the optimum interference for a particular impeller 30 and shaft 20. The nominal sizes in a manufactured set of spacers can be determined based on a determined allowable range of distances between the interfacing surfaces 18, 39 of the impeller 30 and the shaft 20, which can be a statistically determined trend of manufacturing tolerances. The size (axial thickness) and associated tolerance of a set of spacers can be pre-determined so as to allow a rapid assembly of the impeller 30 to the shaft 20, while achieving the optimum interference between the interfacing profiles of the impeller stem 34 and the shaft 20.

For example, for a given rotor assembly 10, a finite set of compliant spacers 60 can be provided, such as a set of three or a set of five spacers. The set is designed to achieve, based on the manufacturing tolerances, the optimal diametral interference between the harmonic profiles of the impeller stem 34 and the shaft 20. Each individual set of spacers 60 satisfies a range of possible values of the measurable axial gap between the indicated interfacing surfaces of the impeller 30 and the shaft 20 with the result of consistently obtaining a diametral interference at assembly between the impeller stem 34 and the shaft 20 within the optimal range of values.

The selection, from a design point of view, of a finite number of the compliant spacers in a set that are characterized by a different axial thickness, is based on the optimal value of the diametral interference at assembly between the impeller stem 34 and the shaft 20 and the predicted statistical properties of the manufacturing process. Such an approach is advantageous from a manufacturing perspective since a specifically matched single spacer does not need to be machined ad hoc to match a particular impeller to shaft spacing, but can be selected from a set having various sizes.

Additionally, in one embodiment, the end portion 26 of the shaft 20 that interfaces the spacer 60 can also encompass elastic compliant features. For example, pads 27 and undercut grooves 28 of the end portion 26 or beneath the interface surface of the shaft 20 with the spacer 60 are machined to promote displacement compliance in the radial, circumferential and axial directions, thus providing for manufacturing flatness and parallelism errors between the interfacing surfaces of the impeller 30, the spacer 60 and the shaft 20. The compliant features also effectively modify the stiffness of the attachment in the radial, circumferential and axial directions so as to enhance the clamping action of the bolt 40. Furthermore, the tuning of the axial stiffness improves the distribution of the load between the bolt 40, the impeller 30 and the shaft 20 so as to insure contact between the interfacing surfaces during the operation of the rotor.

Figure 6:
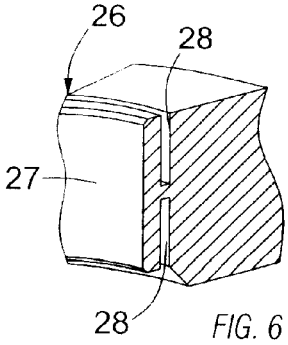
FIGS. 6 and 7 are partial isometric views showing various shaft end portion configurations.
Figure 7:
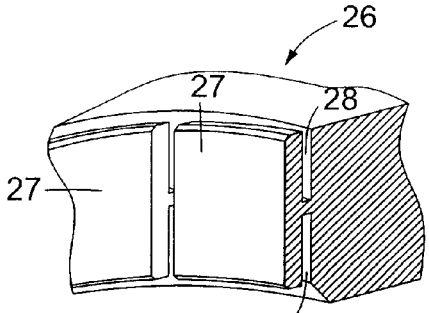
Figure 10:
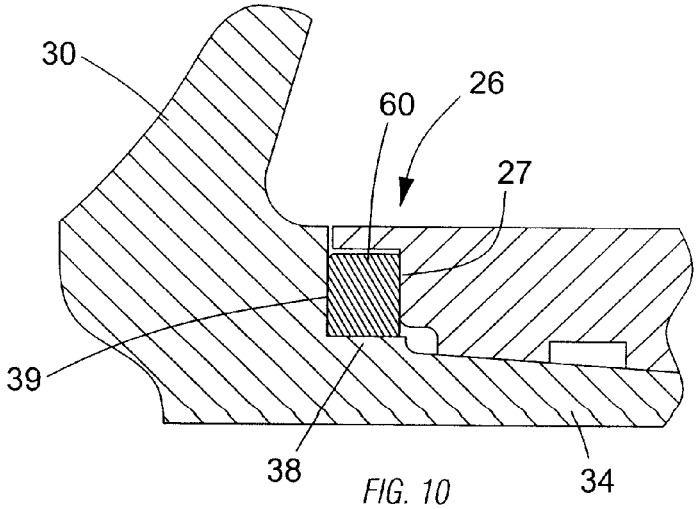
FIG. 10 is similar to FIG. 3 and shows the interconnection of a shaft and impeller that is a second embodiment of the present invention.
Figure 11:
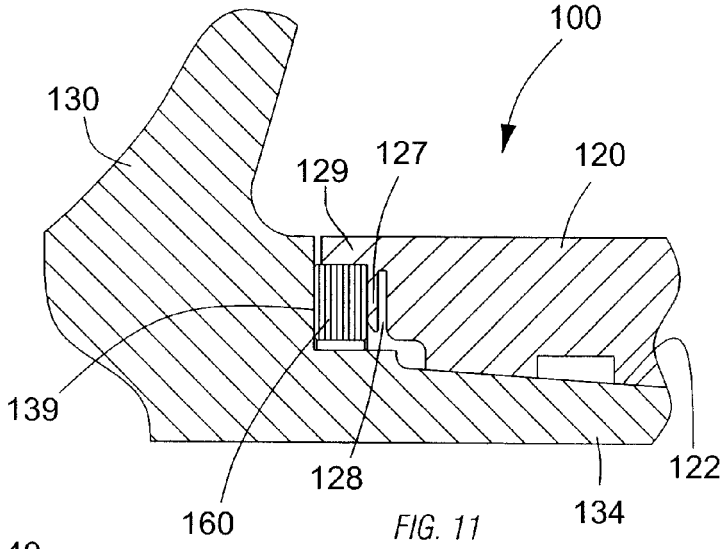
FIG. 11 is similar to FIG. 3 and shows the interconnection of a shaft and impeller that is a third embodiment of the present invention.

FIGS. 5 and 20–22 illustrate various configurations of the shaft end portion 26 with grooves 28 provided in various locations to define various contact pads 27. As illustrated in FIG. 6, the pad 27 may be a continuous pad about the circumference of the shaft end portion 26, or, as illustrated in FIG. 7, the pad 27 may be defined by multiple pad surfaces about the circumference of the shaft end portion 26. Additionally, as illustrated in FIGS. 5 and 20–22, the end portion 26 may be without any grooves to provide a solid contact pad 27. Furthermore, as illustrated in FIG. 10, the contact pad 27 may be provided recessed with respect to the end of the shaft 20 such that a portion of the shaft 20 extends over the compliant spacer 60. The selection and the dimensions of the compliant features on the shaft end portion 26 depend on the geometry of the spacer 60. The relative position of the compliant features on the shaft end portion 26 with respect to the compliant spacer 60 is analytically and experimentally pre-determined so as to achieve the intended functionality.

The presence of redundant alignment features in both the spacer 60 and the shaft 20 minimizes the impact of manufacturing tolerances, thus enhancing the economical production of the components while enhancing their mechanical performance.

The introduction of the compliant spacer 60 and the optional presence of the compliant features on the end portion 26 of the shaft 20 allow for the reconditioning of used parts without hindering the overall geometric dimensions of the rotor assembly system. The available option to recondition rotor assemblies to a new and improved status is of significant importance to the owner of the turbomachine.

Having described the components of the rotor assembly 10, the assembly thereof will now be described with reference to FIGS. 3 and 8–9. As mentioned, the harmonic multi-lobe tapered configurations of the impeller stem 34 and the shaft 20 have geometric radial dimensions so as to develop a mutual diametral interference as the connection is fully assembled. A set of compliant diametral clearance adjusting spacers 60 is also designed to accommodate, in a discrete sense, the range of manufacturing tolerances of the interfacing components. A standard gap measuring gage can be used to determine the separation between the surface 18 of the shaft 20 and the flat, radial surface 39 on the impeller 30 normal to the impeller stem axis.

Figure 8:
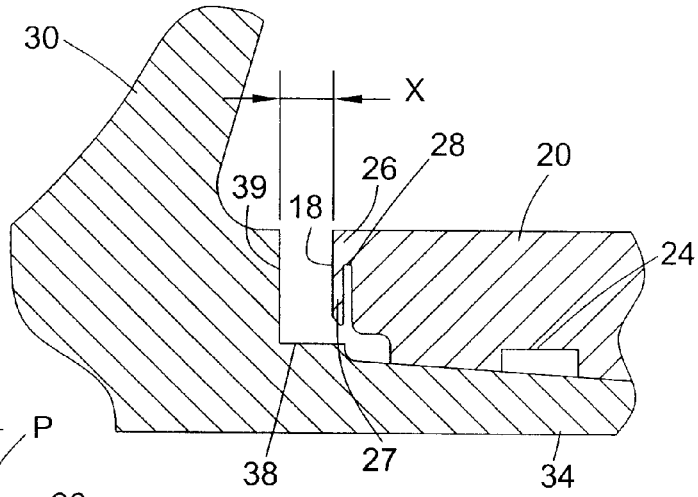
FIGS. 8 and 9 are similar to FIG. 3 and show the sequential assembly of the impeller and shaft.

Step 1:

The impeller stem 34 and the shaft 20, at a common room temperature, are hand assembled so as to insure contact between the mating harmonic profiles, as illustrated in FIG. 8.

Step 2:

The bolt 40 and the washer 50 are assembled to the impeller 30. The bolt 40 is then hand tightened to prevent the free axial movement of the assembled components.

Step 3:

The axial gap X between the interfacing surface 39 on the impeller 39 and surface 18 of the shaft 20, without the compliant spacer 60 interposed, is measured, as illustrated in FIG. 8.

Step 4:

A suitable compliant spacer 60, within the given set, is selected based on the axial gap X measurement conducted at Step 3. The selected compliant spacer 60 will preferably have an axial width W that is less than the axial gap X so as to leave a pull-up space P.

Step 5:

The bolt 40 and the washer 50 are disassembled.

Figure 9:
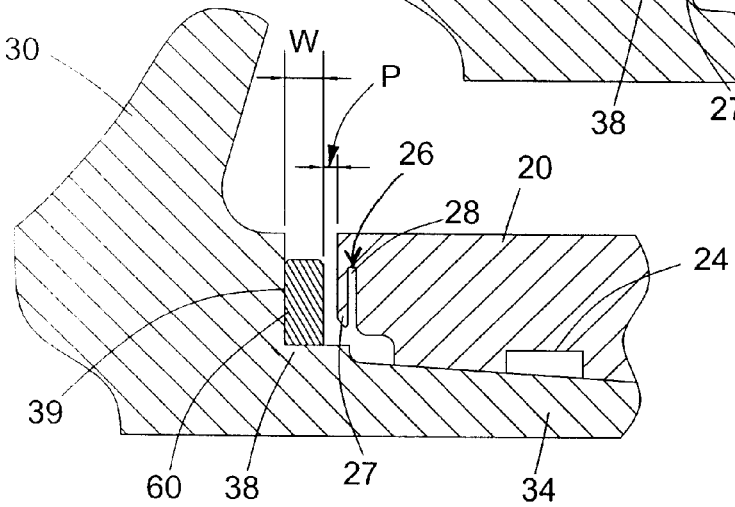

Step 6:

The selected compliant spacer 60 is pre-heated to a specified temperature rise above room temperature, and then assembled onto the spacer seat 38 provided on the impeller stem 34 as illustrated in FIG. 9.

The subsequent assembly steps are to be accomplished only after the impeller and the compliant spacer have reached a common room temperature.

Step 7:

The bolt 40 and bolt washer 50 are assembled to the impeller 30. The bolt 40 is then hand tightened to prevent the free axial movement of the assembled components.

Step 8:

The residual axial gap P, namely the pull-up length, between the compliant spacer 60 and the shaft surface 18, is measured, as specified for the particular option of the attachment, and then compared against the specified allowable range.

Step 9:

The bolt 40 is tightened up to the specified assembly torque value with a calibrated torque wrench.

Step 10:

The bolt 40 is loosened, and then again tightened up to the specified assembly torque value with a calibrated torque wrench.

Step 11:

The impeller-to-shaft coupling is checked for residual gaps between the interfacing surfaces of the impeller 30, compliant spacer 60 and shaft 20.

Step 12:

The complete rotor assembly is then dynamically balanced as per engineering specification, and components match marked prior to rotor disassembly for shipment or installation in the turbomachine.

The detachment of the impeller from the shaft is accomplished by the following procedure:

Step 1:

The bolt 40 is loosened, and both the bolt 40 and the bolt washer 50 are manually extracted from the impeller 30.

Step 2:

A conventional extraction tool can be used to axially separate the impeller stem 34 from the shaft 20. Features in the impeller 30 may be provided to accommodate the use of conventional or ad hoc extraction tools.

With the impeller 30 and shaft 20 interconnected, the torque is transmitted across the connection by the harmonic multi-lobe tapered profile coupling. The impeller stem 34 and the shaft 20 are assembled so as to insure a calibrated diametral interference at the boundaries of the two components. The non-conforming to rotation multi-lobe harmonic profile allows for a unique angular orientation of the components to insure consistent mounting of the parts and consequently to maintain the rotor assembly's overall balance. Torque transmission is insured by the shape of the impeller stem 34 and hub 22, while the diametral interference insures a positive engagement and prevents fretting or galling between the components to occur. The condition of diametral interference is maintained during all operating conditions of the fluid turbomachine, thus allowing for no relative axial, radial or circumferential displacements between the components of the joint. All the parts of the joint, in the three spatial directions, are forcefully maintained in contact against each other, thus preventing fretting between the interfacing surfaces. Particularly, the calibrated bolt axial pre-load at assembly, the elastic compliance of the spacer 60 interposed between the impeller 30 and the shaft 20 and the pre-loading of any compliant feature at the end portion 26 of the shaft 20 insure a prevailing axial clamping condition of the connection under all operating conditions when the axial contraction and forward displacement of the clamped impeller occur due to body forces generated by rotation, non-symmetric stiffness conditions, and temperature gradients.

An impeller and shaft assembly 100 that is an alternate embodiment of the present invention will be described with reference to FIGS. 11–14. The assembly 100 is similar to the previous embodiment and includes an impeller 130, a shaft 120, a bolt and washer (not shown) and a compliant spacer 160. The impeller 130 includes a stem 134 received in a shaft bore 122. The alternate coupling configuration is designed so that the location of contact and interference of the compliant spacer 160 with the shaft 120 occurs at the outer diameter instead of at the inner diameter of the spacer 160. The spacer 160 is interference fit at a shoulder 129 defined at the end of the shaft 120. The spacer 160 is positioned at the shoulder 129 until it contacts the radial contact pad 127 of the shaft 120. A groove 128 or the like may be provided as in the previous embodiment. Additionally, the spacer 160 may have various configurations as in the previous embodiment. The interference conditions and functionality of the compliant spacer 160 remain unaltered when the spacer 160 is located at the shoulder 129 of the shaft rather than the shoulder 38 of the impeller 30. The assembly of the spacer 160 in this configuration may follow the procedure described above, or may require the heating of the shaft end portion 26, and/or the cooling of the compliant spacer 160.

Figure 12:
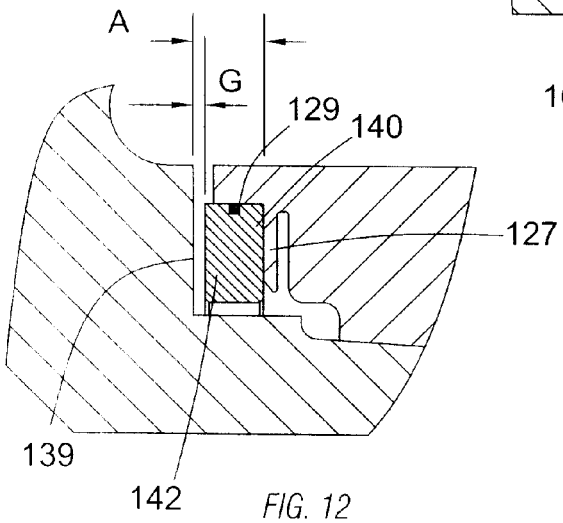
FIG. 12 is similar to FIG. 11 and shows a step in the assembly of the shaft and impeller of FIG. 11.
Figure 13:
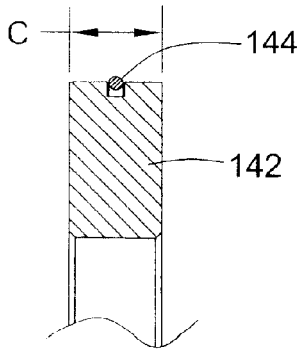
FIG. 13 is a partial cross-sectional view of a spacer gage utilized in the assembly as illustrated in FIG. 12.
Figure 14:
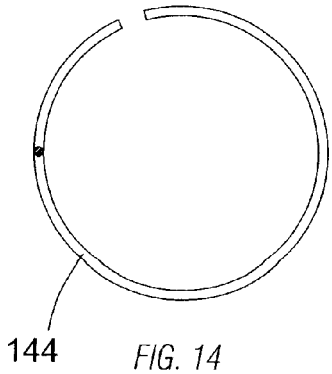
FIG. 14 is a side elevational view of a spring ring utilized in the assembly as illustrated in FIG. 12.

The impeller 130 and shaft 120 are generally assembled as described with the prior embodiment. Prior to assembly of the spacer 160 to the shaft 120, the distance A between the shaft contact pad 127 and the impeller surface 139 must be measured, similar to Step 3 above. To measure the distance A, a master spacer gage 140, as shown in FIGS. 12–14, is used. The master spacer gage 140 includes a spacer block 142 having a known width C. The spacer block 142 is held in position on the shaft shoulder 129 by a ring spring 144 or the like. With the master spacer gage 140 in place, the impeller 130 and shaft 120 are connected via hand tightening as in Step 2 above. The gap G between the spacer block 142 and the radial shoulder 139 is measured and the distance A is computed by adding the gap G with the spacer block width C. Once the distance A is determined, a spacer 160 having the desired configuration is selected and the impeller 130 and shaft 120 are connected in the manner described above with respect to the first embodiment.

Various advantages are inherent in the described embodiments of the rotor assembly. In particular, the rotor assembly can be assembled and disassembled without degrading the components of the rotor assembly. Further, only a bolt is required to connect the impeller to the shaft, and there is no need for another support system during assembly.

With the use of the compliant spacer, the customary high precision manufacturing requirements related to the machining of the configurations of the interfacing outer surface of the impeller stem and the inner surface of the shaft can be significantly relaxed such that a highly functional rotor assembly can be economically produced. The introduction of a finite set of compliant spacers supports the relaxation in manufacturing tolerance of the profiles and allows for the optimal interference between the impeller stem and the shaft to be achieved. The control in the achievable interference at assembly between the impeller stem and the shaft also allows for the use of interfacing components that are outside the manufacturing allowable limits, thus preventing the time delay related to the reconditioning of the affected components of the coupling. The interference controlling compliant spacer absorbs the manufacturing inevitable flatness and parallelism errors present in the interfacing surfaces of the impeller and the shaft, thus allowing for a desirable self-adjusting condition of the rotor assembly. The compliant spacer makes the factory repair of a used rotor assembly simpler.

The introduction of a compliant spacer effectively decouples, in a tapered attachment assembled to an axial mechanical stop, the manufacturing tolerance induced diametral interference from the optimal diametral interference required for the attachment's functionality. The introduction of a compliant spacer allows for the setting of an optimal interference between the mating profiles on the impeller stem and the shaft resulting in an effective constraint to radial, circumferential and axial displacements during rotor assembly balancing and subsequent operation in the turbomachine. The introduction of a compliant spacer improves repeatability in the location of the components of the rotor assembly after dismounting, thus improving retention of the pre-balanced condition and preventing the development of rotor vibration during operation.

The introduction of a compliant spacer tunes the axial stiffness of the coupling, thus improving the load distribution between the bolt, the impeller stem and the shaft during assembly and in operation, and improves surface contact between the interfacing surfaces so as to significantly reduce the initiation of galling and/or fretting between the assembled components. The introduction of a compliant spacer allows for the refurbishing of used rotors with a relatively minimum effort and associated costs.

The introduction of an elastically compliant surface at the end-face of the shaft improves the axial alignment of the connected components, allowing for improved contact in operation between the mating surfaces, and for an efficient utilization of the bolt clamping force. The introduction of an elastically compliant surface at the end-face of the shaft also tunes the axial stiffness of the attachment, thus improving the load distribution between the bolt, the impeller stem and the shaft, and improves surface contact between the interfacing surfaces so as to significantly reduce the initiation of galling and/or fretting between the assembled components.

What is claimed is:

1. A rotor assembly for a turbomachine, comprising:

an impeller operable to rotate around an axis and having an opening extending in an axial direction, the impeller also including a stem with an outer surface having a tapered profile in a cross section including the axis and a non-circularly symmetric profile in a cross section perpendicular to the axis, a rotatable shaft including a bore extending in the axial direction, wherein the bore is configured to receive the impeller stem and engage the impeller stem when the shaft is rotating, a bolt inserted in the impeller opening and the bore for connecting the impeller to the shaft, and a compliant spacer between a first surface of the shaft and a first surface of the impeller, wherein the compliant spacer substantially conforms to the first surface of the shaft and to the first surface of the impeller when the bolt is tightened to a predetermined torque value.

2. The rotor assembly of claim 1, wherein the bore is defined by an inner surface of the shaft having a generally tapered profile in a cross section including the axis and a non-circularly symmetric profile in a cross section perpendicular to the axis which mates with the non-circularly symmetric profile of the impeller stem.

3. The rotor assembly of claim 1, wherein the non-circularly symmetric profile of the stem is a multi-lobe harmonic profile.

4. The rotor assembly of claim 1, wherein the first surface of the shaft and the first surface of the impeller are substantially perpendicular to the axis.

5. The rotor assembly of claim 1, wherein an end portion of the shaft is compliant in the axial direction.

6. The rotor assembly of claim 5, wherein an end portion of the shaft includes one or more grooves and one or more compliant pads.

7. The rotor assembly of claim 1, wherein the compliant spacer is removably attachable to one of a shoulder of the impeller and a shoulder of the shaft.

8. The rotor assembly of claim 1, wherein when the stem is inserted in the bore and the bolt is tightened to a predetermined torque value, a non-inserted end of the impeller stem extends from the bore.

9. The rotor assembly of claim 1, wherein when the stem is inserted in the bore and the bolt is tightened to a predetermined torque value, the bore extends beyond the inserted end of the impeller stem.

10. The rotor assembly of claim 1, wherein the compliant spacer is stainless steel.

11. The rotor assembly of claim 1, wherein the compliant spacer is one of a 303 grade stainless steel and a 304 grade stainless steel.

12. The rotor assembly of claim 1, wherein the compliant spacer is selected from a finite set of manufactured compliant spacers of differing nominal sizes.

13. A rotor assembly for a turbomachine, comprising:

an impeller operable to rotate around an axis and having an opening extending in an axial direction, the impeller also including a stem with an outer surface having a tapered profile in a cross section including the axis and a non-circularly symmetric profile in a cross section perpendicular to the axis, a rotatable shaft including a bore extending in the axial direction, wherein the bore is configured to receive and engage the impeller stem when the shaft is rotating, a bolt insertable into and through the impeller opening and into the bore for connecting the impeller to the shaft, wherein the bore is defined by an inner surface of the shaft having a generally tapered profile in a cross section including the axis and a non-circularly symmetric profile in a cross section perpendicular to the axis which mates with the non-circularly symmetric profile of the impeller stem, and a compliant spacer between a first surface of the shaft and a first surface of the impeller, wherein the first surface of the shaft and the first surface of the impeller are substantially perpendicular to the axis and the compliant spacer substantially conforms to the first surface of the shaft and to the first surface of the impeller when the bolt is tightened to a predetermined torque value.

14. The rotor assembly of claim 13, wherein the non-circularly symmetric profile of the stem is a multi-lobe harmonic profile.

15. The rotor assembly of claim 13, wherein an end portion of the shaft includes one or more grooves and one or more compliant pads that are compliant in the axial direction.

16. The rotor assembly of claim 13, wherein the compliant spacer is removably attachable to one of a shoulder of the impeller and a shoulder of the shaft.

17. The rotor assembly of claim 13, wherein when the stem is inserted in the bore and the bolt is tightened to the predetermined torque value, a non-inserted end of the tapered impeller stem extends from the bore and the tapered bore extends beyond the inserted end of the impeller stem.

18. The rotor assembly of claim 13, wherein the compliant spacer is one of a 303 grade stainless steel and a 304 grade stainless steel.

19. The rotor assembly of claim 13, wherein the compliant spacer is selected from a finite set of manufactured compliant spacers of differing sizes.

20. A method for assembly a rotor assembly operable to rotate around an axis, the method comprising:

inserting a tapered, non-circularly symmetric impeller stem of an impeller into a bore of a shaft, inserting a bolt into an opening of the impeller and into a threaded portion of the bore of the shaft, manually tightening the bolt to just prevent the movement of the impeller in an axial direction, measuring a gap between a first surface of the impeller and a first surface of the shaft, wherein both surfaces are generally perpendicular the axis, selecting a suitable compliant spacer from a predetermined set of nominally sized compliant spacers, wherein the selected spacer has a thickness less than the measured gap, removing the bolt and the impeller, providing an interference fit between the selected compliant spacer and a shoulder of one of the impeller stem and the shaft, re-inserting the impeller stem into the bore, re-inserting the bolt into the impeller opening and shaft bore, and manually tightening the bolt to just prevent the movement of the impeller in an axial direction, and tightening the bolt to a predetermined torque value.

* * * * *